US006951438B2

(12) United States Patent
Carpenter

(10) Patent No.: US 6,951,438 B2
(45) Date of Patent: Oct. 4, 2005

(54) EROSION CONTROL TRANSITION MAT

(76) Inventor: Thomas J. Carpenter, 3718 SW. Court Ave., Ankeny, IA (US) 50021

( * ) Notice: Subject to any disclaimer, the term of this patent is extended or adjusted under 35 U.S.C. 154(b) by 1 day.

(21) Appl. No.: 10/759,684

(22) Filed: Jan. 16, 2004

(65) Prior Publication Data

US 2005/0158130 A1 Jul. 21, 2005

(51) Int. Cl.[7] ..... E02D 31/00
(52) U.S. Cl. ..... 405/302.6
(58) Field of Search ..... 405/119, 118, 120–126, 405/302.6; 52/16

(56) References Cited

U.S. PATENT DOCUMENTS 2,334,779 A * 11/1943 Luff ..... 405/119
2,898,939 A * 8/1959 Fox ..... 405/119
3,636,830 A * 1/1972 Watts ..... 405/119
5,358,356 A 10/1994 Romanek et al.
5,651,641 A 7/1997 Stephens et al.
6,394,700 B1 * 5/2002 Fish ..... 405/124

* cited by examiner

*Primary Examiner*—Frederick L. Lagman
(74) *Attorney, Agent, or Firm*—Brett Trout

(57) ABSTRACT

An erosion control transition mat for reducing scour and destructive erosion at the transition between hard armor and soft armor erosion control surfaces. The erosion control transition mat is provided with a riser and a plurality of voids which collect to slow and divert effluent from the hard armor to reduce scour and impact on the soft armor. The erosion control transition mat is lightweight and of a low-cost manufacture, and may be installed without the need for large equipment.

20 Claims, 4 Drawing Sheets

EROSION CONTROL TRANSITION MAT

BACKGROUND OF THE INVENTION

1. Field of the Invention

The present invention relates in general to a mat for reducing erosion and, more particularly, to a rigid transition mat secured to hard armor and extending over the transition area from a hard armor erosion control surface to a soft armor erosion control surface.

2. Description of the Prior Art

The Clean Water Act and subsequent legislation requires storm water to be discharged in a non-erosive manner. Unfortunately, storm water pipe outlets and the like used to divert water runoff are highly erosive at their outlets as the result of velocity and shear force problems associated with the funneling of water toward a narrow outlet. Erosion control associated with such outlets involve economic, physical and logistical problems. Traditionally, storm water is transported from a street or parking lot in a storm water pipe to a conveyance, such as a stream or river. Storm water may also be drained from a permanent structure, like a parking lot, at designated outlets where it flows overland and naturally dissipates. The soil area adjacent such discharge points is highly susceptible to severe erosion associated with discharging water.

The energy of water discharging from such outlets varies with the of velocity, shear force and volume of the effluent. Water 25 centimeters deep, flowing rapidly, is much more erosive and destructive than water 8 centimeters deep, flowing at the same rate. Accordingly, allowing runoff water to spread out is an effective means to counteract funneling of discharge water, dissipating both velocity and shear force without mechanical input. Conversely, squeezing water raises its height and increases its hydraulic pressure. This increase in hydraulic pressure results in increased shear force which, in turn, leads to increased erosion. Unfortunately, the factors associated with diverting water, namely collecting water from a relatively large area and funneling it to a very small area, using hard, smooth surfaces, cannot help but magnify the weight, velocity and shear force of the water at the discharge point.

Traditionally, at such discharge points, material, such as rip rap, is added. Such installation of various sized rocks, stacked in a concave manner to funnel water, may be used to reduce erosion, but is very expensive and time consuming to install. Alternatively, concrete blankets (flat soft material filled with concrete or concrete blocks held together with steel cables), or concrete slabs may be used to control erosion at discharge points. These products, and other similar products, are referred to as "hard armor." Hard armor often dissipates water energy and protects the soil therebeneath from eroding away and polluting natural resources. One drawback associated with hard armor is the requirement of very large equipment needed to install the hard armor. Additionally, a significant volume of material must be freighted to the site and a large amount of preparatory work is required before installing the hard armor.

While hard armor is useful for dissipating velocity and countering shear forces associated with runoff water, poor installation often allows the water to splash or divert out of the designated channel, many times leading to the erosion and washout of the hard armor installation itself. While concrete blankets are better able to withstand velocity and shear forces, they do little to inhibit the velocity and, therefore, the destructive force of water runoff. Another drawback associated with hard armor is that it typically lacks aesthetics associated with other forms of erosion control.

Recently, the industry has developed blanket-type products called turf reinforcement mats to convey water and withstand designated loads. While such turf reinforcement mats do little to reduce or mechanically dissipate the energy of runoff water energy themselves, their installation allows for the growth of vegetation which, in turn, mechanically reduces energy associated with runoff water. Such blankets are typically three-dimensional, flexible mats constructed of plastic webbing. The open weave of such mats allows vegetation to grow up therethrough. The combination of the mechanical stable structure and open weave design results in a significant synergistic effect, with the capacity to carry much greater velocity and sheet force load because roots and stems associated with the upgrowing vegetation are reinforced by the mat.

One drawback associated with such turf reinforcement mats is the inability to gain sufficient vegetation growth before the energy associated with runoff washes the seeds or small plants away. Moreover, if sufficient vegetation does not occur, the mats often fail from soil erosion. The greatest incidents of failure of such turf reinforcement mats, canvas and other associated types of "soft armor," occur at butt connecting joints, either between two pieces of soft armor, or between soft armor and hard armor. Typically specifications call for trenching perpendicular to the flow of water, and overlapping or wrapping of blanket material in the trench area. The trench is then filled with soil, packed, and the blanket material folded back against the trench.

If, as is often the case, the soil is inadequately compacted at this trench, runoff seeps into the trench, washing away the soil contained therein, and leading to failure of the trench retainment construction. It would, therefore, be desirable to provide an erosion control system which avoided the failure problems associated with soft armor, and which avoided prior art problems associated with soft armor transition areas and transition areas between hard armor and soft armor. The difficulties in the prior art discussed hereinabove are substantially eliminated by the present invention.

SUMMARY OF THE INVENTION

In an advantage provided by this invention, a transition mat is provided which is of a lightweight, low cost manufacture.

Advantageously, this invention provides an erosion control transition mat with a high resistance to failure associated with erosion.

Advantageously, this invention provides an erosion control transition mat which provides for quick and easy installation without the requirement for heavy machinery.

Advantageously, this invention provides an erosion control transition mat which slows and dissipates runoff water.

Advantageously, this invention provides an erosion control transition mat which is aesthetically pleasing.

Advantageously, this invention provides an erosion control transition mat which allows for the growth of vegetation therethrough, increasing its aesthetics and utility.

Advantageously, this invention provides an erosion control transition mat which is durable.

Advantageously, in a preferred example of this invention, an erosion control transition mat system is provided. The erosion control mat is secured to hard armor at the transition point between the hard armor and soft armor. The erosion control mat is provided in overlapping relationship, relative to the hard armor and soft armor, preferably overlapping both the hard armor and soft armor. The erosion control transition mat is preferably provided with a riser to direct runoff upward and disrupt smooth flow of effluent. The erosion control transmittal mat is provided with a plurality of holes to allow runoff to pass through into contact with the soft armor, and to allow vegetation to grow up therethrough, further decreasing the velocity and dissipating runoff, as well as adding aesthetics to the system.

BRIEF DESCRIPTION OF THE DRAWINGS

The present invention will now be described, by way of example, with reference to the accompanying drawings in which.

DETAILED DESCRIPTION OF THE PREFERRED EMBODIMENT

An erosion control transition mat (10) according to this invention is shown in overlapping relationship with a section of hard armor (12) and soft armor (14). While the hard armor (12) may be rocks of varying sizes, typically referred to as "rip rap," concrete blankets (flat sock material filled with concrete or concrete blocks held together with steel cables), or any other similar material, in the preferred embodiment, the hard armor (12) is a concrete slab approximately two to 25 centimeters thick. It should be noted, however, that the present invention may be utilized with any type of hard armor (12) known in the art.

The soft armor (14) may be porous plastic sheeting, canvas, dense vegetation, or any other similar soft armor known in the art. In the preferred embodiment the soft armor is a turf reinforcement mat, such as those known in the art. Such turf reinforcement mats are typically blankets having a three dimensional structure, such blankets being flexible, often constructed of plastic webbing, and having a variegated thickness of between 0.5 centimeters and 3 centimeters. Such turf reinforcement mats are typically provided with a porous weave, sufficient to allow vegetation to grow up through the mats to aid in their effectiveness, maintain the turf reinforcement mat in place, and increase the aesthetics of the installation.

Figure 2:
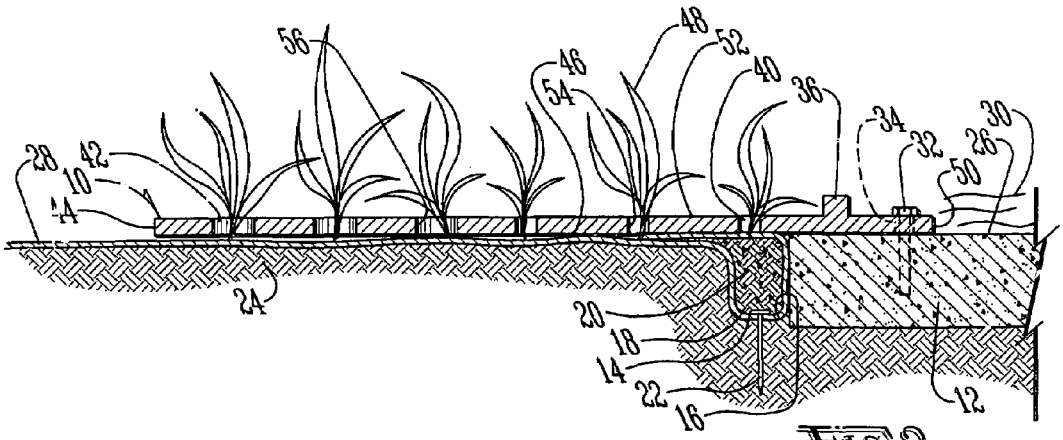
FIG. 2 illustrates a side elevation in cross-section of the erosion control transition mat of FIG. 1.

As shown in FIG. 2, in a typical installation, a trench (16) is typically cut perpendicular of the desired flow of runoff. The soft armor (14) is then laid in the trench and the trench is backfilled with the removed soil (18), aggregate (20) and/or similar material. Additionally, the soft armor (14) contained within the trench (16) may be secured by spikes or staples (22) or the like, driven into the soil (24). Once the trench has been filled, the soft armor (14) is laid back over the trench (16) to produce the orientation shown in FIG. 2. Locking in the soft armor (14) in this manner attempts to reduce the failure rate associated with the soft armor (14) at the sensitive transition between the soft armor (14) and hard armor (12).

At the transition site between the hard armor (12) and soft armor (14), the soft armor (14) must rely solely on the aggregate (20) and staples (22) provided within the trench (16) to avoid being washed away. Compounding the problem is the height differential between the top surface (26) of the hard armor (12) and the top surface (28) of the soft armor (14). With this added height, the effluent (30) gains momentum as it drops and capillary action directs the effluent (30) along the edge of the hard armor (12), directly into the portion of the soft armor (14) located above the trench (16).

Accordingly, the greatest erosive effect of the effluent (30) is transferred to the soft armor (14) at its weakest point. Although if effectively installed, the soft armor (14) can typically withstand these erosive effects for a period of time, if the soft armor (14) is incorrectly installed, or vegetation or seeds positioned within the soft armor (14) are not given a chance to take root, are washed away or are otherwise prevented from germinating, the soft armor (14) may begin to move away from the hard armor (12), exposing the unprotected soil (14) to the direct erosive effects of the effluent (30) cascading from the hard armor (12). Such a situation often leads to catastrophic failure of the system and wholesale erosion of the soil (24).

Figure 1:
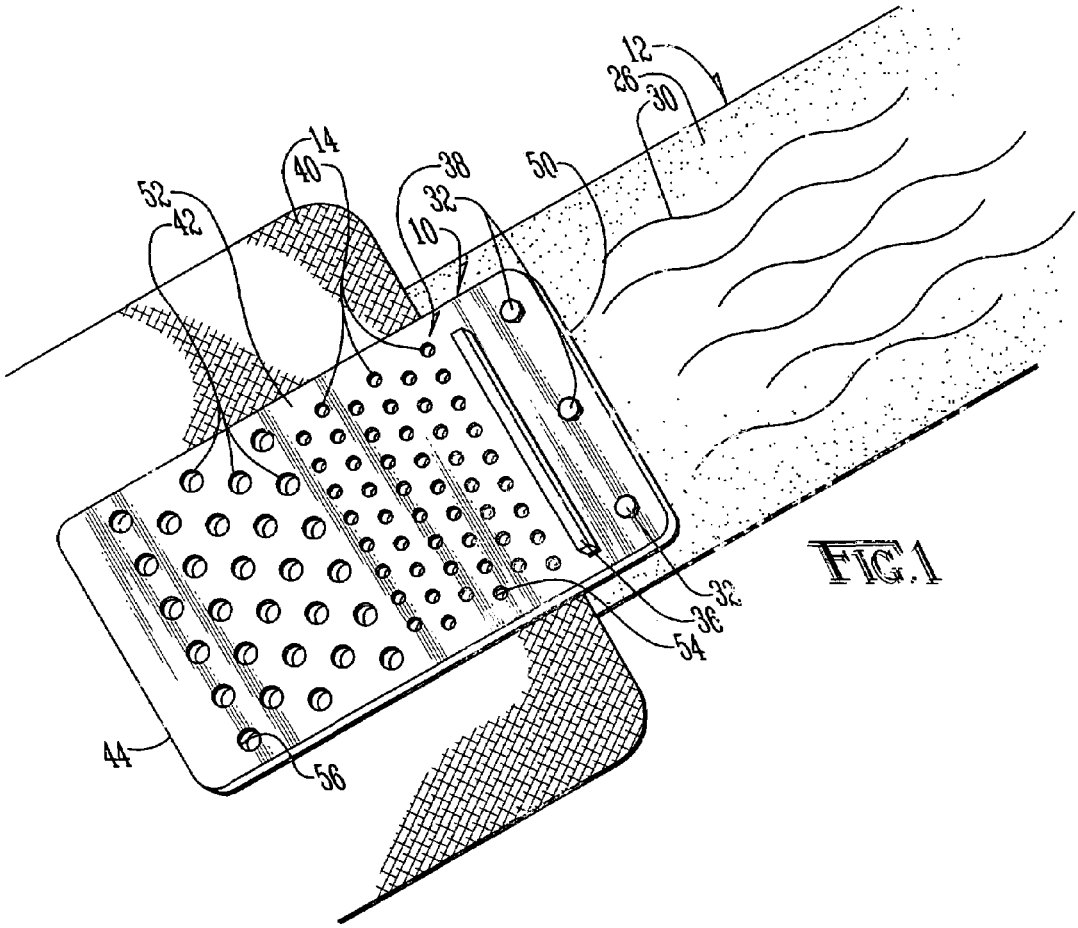
FIG. 1 illustrates a top perspective view of the improved erosion control transition mat of the present invention.

To prevent the problems associated with erosion of the soft armor (14), the erosion control transmission mat (10) is secured to the hard armor (12) by lag bolts (32) provided through holes (34) in the erosion transition mat (10), or by similar concrete securement means known in the art. (FIG. 1). While the erosion control transmission mat (10) may be constructed of any suitable material, in the preferred embodiment the mat (10) is constructed of polyvinyl chloride approximately 1 meter wide and 2 meters long. Although the mat (10) may be constructed of any suitable dimensions, the mat is preferably constructed of a thickness between 1 mm and 10 cm thick, more preferably between 0.5 cm and 5 cm thick, and most preferably between 1 cm and 3 cm thick. The mat (10) is also preferably constructed having a length at least equal to its width, more preferably at least 1.5 times its width, and most preferably at least about twice its width.

As shown in FIG. 1, the first 15 centimeters of the mat (10) is clear of impediments and voids to provide room for attaching the mat (10) to the hard armor. As shown in FIGS. 1 and 2, the mat (10) is provided with a riser (36), preferably constructed of polyvinyl chloride and mechanically attached to the mat (10) using adhesive or other fasteners known in the art. Alternatively, the riser (36) may be integrally molded with the mat (10). As shown, the riser (36) is preferably 2 centimeters high, 4 centimeters deep, and extends just short of the edges of the mat (10). Downstream from the riser (36) are a plurality of holes (38). As shown in FIG. 1, a first plurality of holes (40) are smaller in diameter, preferably 4 centimeters in diameter. Larger holes (42), are preferably provided downstream from the first set of holes (40). Although the holes (40) and (42) in the preferred embodiment are circular, the holes may, of course, be provided of any suitable dimensions and configurations. The holes (40) and (42) are preferably circular, greater than 0.5 cm in diameter, and less than 15 cm in diameter, more preferably greater than 3 cm in diameter and less than 12 cm in diameter, and most preferably, between 5 centimeters and 10 centimeters in diameter. Also, as shown in FIG. 1 the holes (40) and (42) are preferably smaller near the riser (36) and larger near the trailing edge (44) of the mat (10).

As shown in FIG. 2, the mat (10) preferably extends over the hard armor (12). The holes (40) and (42) are positioned over the soft armor (14) to allow vegetation (48) to grow up through the holes (40) and (42), adding aesthetics to the mat (10) and further assisting the mat (10) in slowing and diffusing the effluent (30).

As shown in FIG. 2, as the effluent (30) moves down the hard armor (12), the slick surface of the hard armor (12) does little to reduce the erosive energy of the effluent (30). When the effluent (30) reaches the mat (10), the leading edge (50) of the mat (10) forces the effluent upward, decreasing the energy of the effluent (30) contacting the leading edge (50). From there, the effluent (30) moves toward the riser (36) where the effluent (30) again contacts the riser (36), which directs the effluent (30) upward into additional effluent (30), further disrupting the flow and erosive potential of the effluent (30). From the riser (36), the effluent (30) moves downward around the riser (36) and into the top surface (52) of the mat (10), thereby further slowing the forward momentum of the effluent (30).

The effluent (30) then moves over the first plurality of holes (40). As the effluent (30) moves over the first plurality of holes (40), a portion of the effluent (30) is forced by gravity through the first plurality of holes (40). As this portion of the effluent (30) contacts the leading edges (54) of the first plurality of holes, some of the effluent (30) is further slowed and directed downward into the soft armor (14). Although this first part of the soft armor (14) is a relatively weak area, the positioning of the first plurality of holes (40) is designed to carry the effluent (30) over the very weakest portion of the soft armor (14) and the first plurality of holes (40) are sized sufficiently small to direct only a small portion of the effluent (30) onto this portion of the soft armor.

As the effluent (30) continues to move along the mat (10), the effluent (30) reaches the second plurality of holes (42) which are larger and, therefore, direct a larger portion of the effluent (30) downward into the trailing edges (56) of the second plurality of holes (42) and into the soft armor (14). Finally, depending on the volume of effluent (30) traversing the mat (10), a much larger amount of effluent (30) may exit the mat (10) over the trailing edge (44). As noted above, the erosive effects are reduced, since the soil is more stable and resistant to erosion in this area. Also, by this point the erosive forces have diminished considerably due to the effluent (30) spreading out and the disruptive features of the erosion control mat (10).

As shown in FIG. 2, due to the reduced impact of the effluent (30) on the portion of the soft armor (14) located beneath the mat (10), vegetation (48) grows up through the soft armor (14) and through the holes (40) and (42) of the mat (10). This vegetation (48) further redirects the effluent (30) and reduces its erosive impact, while adding to the aesthetics of the mat (10). The holes (40) and (42) of the mat (10) allow sunlight to reach the vegetation (48) even before the vegetation (48) extends through the holes (40) and (42). By allowing sunlight, while protecting the vegetation (48), the vegetation (48) grows more quickly, thereby providing a more effective erosion control surface and greatly reducing the likelihood of the failure of the soft armor (14). The mat (10) may, of course, be designed of any suitable dimensions, or may be produced in large sheets which may be readily custom cut on site to provide the specific desired shape and configuration to accommodate a particular project.

Figure 3:
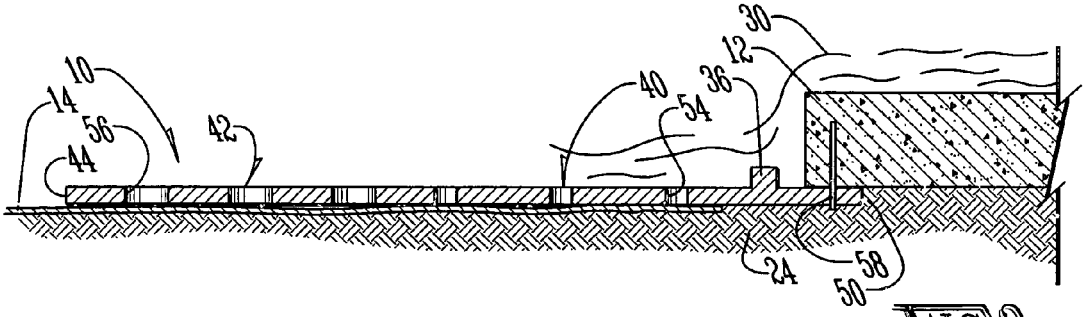
FIG. 3 illustrates a side elevation in cross-section of an alternative embodiment of the erosion control transition mat, shown with the erosion control transition provided in overlapping engagement with the soft armor and hard armor, with the erosion control transition mat being provided under the hard armor.

An alternative installation according to the present invention is shown generally in FIG. 3. Instead of being positioned on top of the hard armor (12) the mat (10) may be inserted on top of the soft armor (14), but under the installation of the hard armor (12). Threaded rebar (58) or the like may be provided through the mat (10) and the hard armor (12) poured thereupon in a manner such as that known in the art. When the hard armor (12) has hardened, the rebar (58) secures the mat (10) to the underneath of the hard armor (12). As shown in FIG. 3, effluent (30) running over the hard armor (12) drops over the edge of the hard armor (12) where it comes into contact with the mat (10). The mat (30) causes a slowing and diffusion of the effluent (30). After the effluent (30) contacts the mat (10), the effluent (30) moves into the riser (36) where the effluent (30 again moves upward and downward, further decreasing its velocity and dissipating the effluent (30). As shown in FIG. 3, in this particular installation, the mat (10) is preferably positioned at a downward slope for more efficient use.

Figure 4:
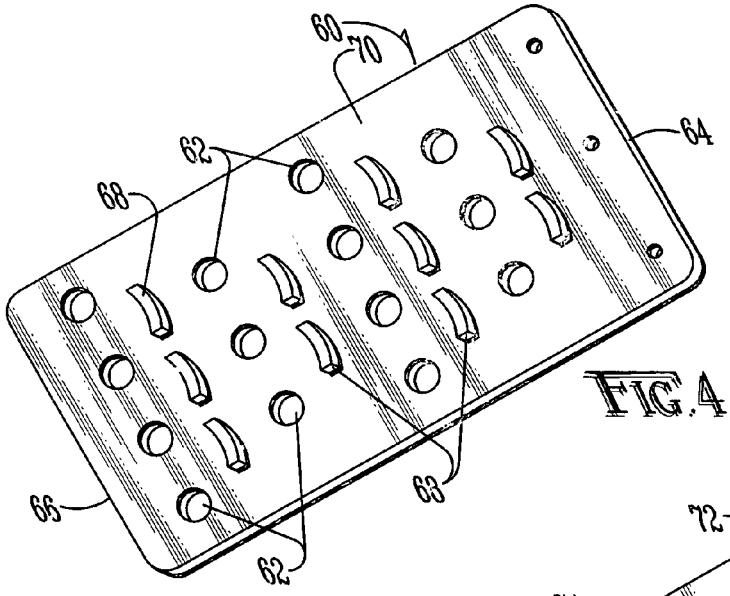
FIG. 4 illustrates a top perspective view of an alternative embodiment of the present invention showing the erosion control transmission mat with a plurality of holes and curved, raised blocks.

Shown in FIG. 4 is an alternative mat (60) of the present invention. As shown, the mat (60) is provided with a plurality of voids (62). Preferably, the voids (62) are of a narrower diameter near the leading edge (64) of the mat (60), and of a larger diameter near the trailing edge (66) of the mat (60). However, as shown in FIG. 4, the voids (62) may be identically sized. As shown in FIG. 4, the mat (60) is provided with a plurality of risers (68). Like the riser (36) described above, the risers (68) are preferably 2 centimeters high and 4 centimeters deep. The risers (68) are arcuate in design and staggered across the top surface (70) of the mat (60). The risers (68) may be secured to the top surface (70) of the mat (60) by adhesive, or any other securement means known in the art. As shown in FIG. 4, the risers (68) and voids (62) are oriented so that each of the risers (68) "feeds" to a void (62). Alternatively, the risers (68) can be positioned concavely toward the leading edge (64) and/or may be provided to shield the voids (62).

Figure 5:
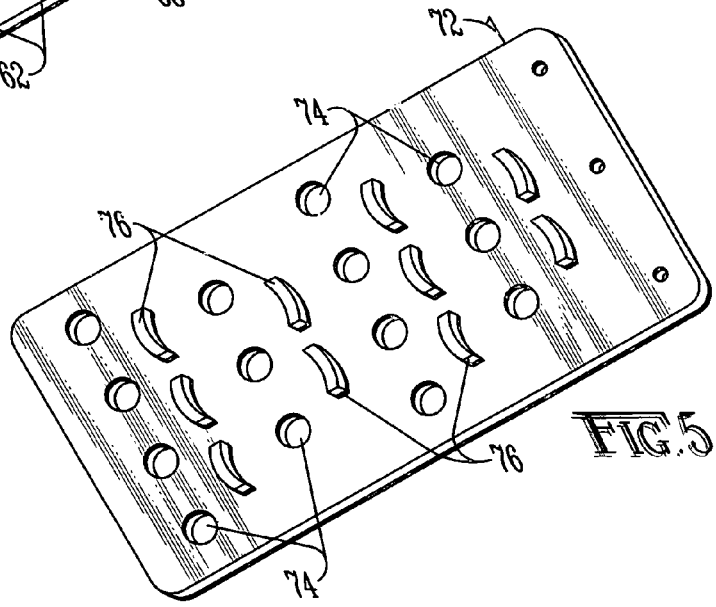
FIG. 5 illustrates a top perspective view of an alternative embodiment of the present invention showing an erosion control transmission mat with a plurality of holes and raised curved blocks staggered between concave and convex positioning relative to the discharge of water.
Figure 6:
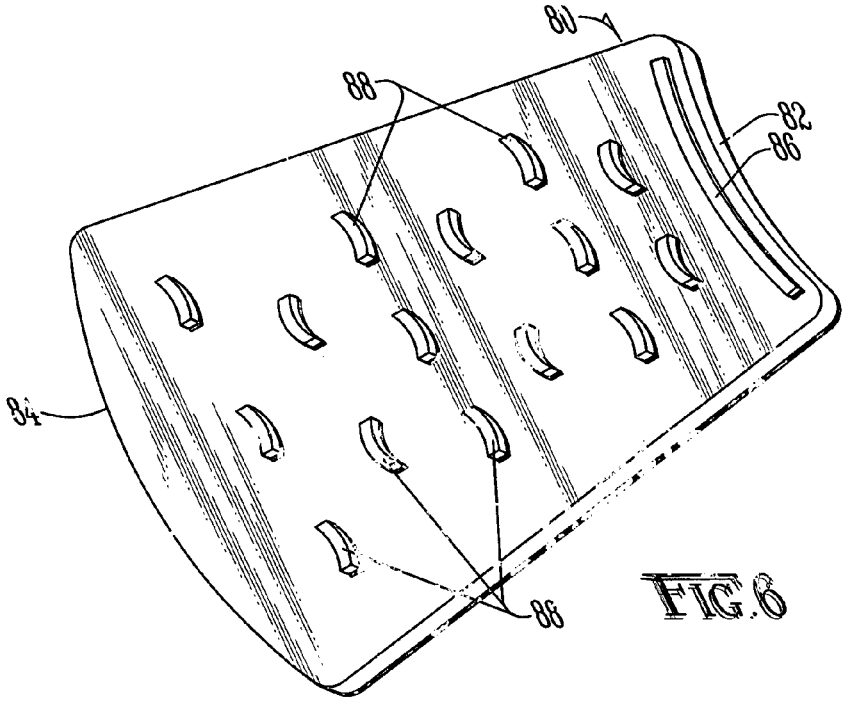
FIG. 6 illustrates a top perspective view of an alternative embodiment of the present invention, shown with a plurality of concave and convex slots provided in a tapered erosion control transition mat.

Yet another alternative embodiment of the present invention is shown generally as (72) in FIG. 5. As shown, the alternative mat (72) is again provided with a plurality of voids (74) and risers (76). Another alternative embodiment of the present invention is shown generally as (80) in FIG. 6. In this embodiment of the present invention, the mat (80) is flared outward so that the leading edge (82) is narrower than the trailing edge (84). The mat (80) is also provided with a curved riser (86) 2 centimeters high and 4 centimeters wide. As shown in FIG. 6, the mat (80) is also provided with a plurality of voids (88). As shown, the voids (88) are arcuate and alternately constructed in rows concavely and convexly oriented relative to the leading edge (82) of the mat (80).

Figure 7:
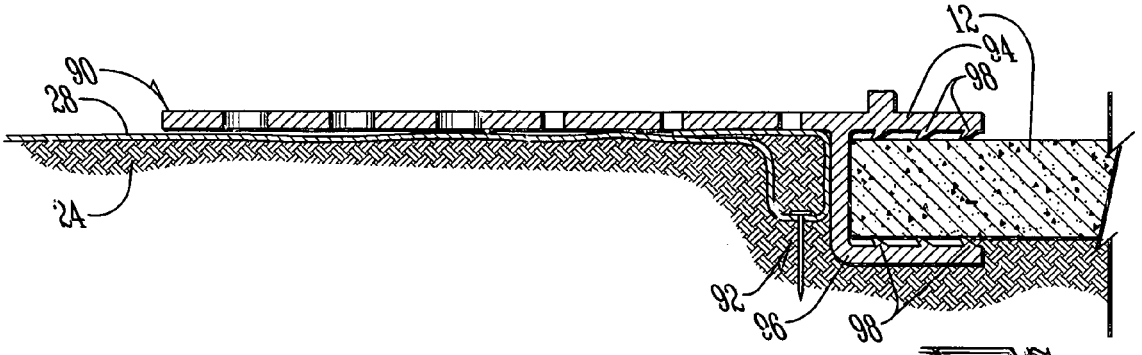
FIG. 7 illustrates a side elevation in partial cross-section of an alternative embodiment of the present invention showing an erosion control transition mat engaged to a hard armor surface using a plurality of rubber fingers.

Yet another alternative embodiment of the present invention is shown generally as (90) in FIG. 7. In this embodiment of the present invention, the mat (90) is provided with a slip and lock system (92), such as that known in the art to secure the mat (90) to the hard armor (12) without the requirement of tools. The slip and lock system (92) is preferably constructed with a PVC shell (94), integrally molded with the mat (90). The shell (94) if preferably designed to be slightly larger than the trailing edge (96) of the hard armor (12) to which it is to be attached. Provided within the shell (94) are a plurality of rubber or otherwise resilient fingers (98), which are preferably slanted inward of the shell (94) to provide a "one-way" attachment of the mat (90) to the hard armor (12). The fingers (98) preferably fold down as the shell (94) is inserted over the trailing edge (96) of the hard armor (12), yet are biased upward to wedge the shell (94) and the mat (90) against inadvertent dislodgement of the shell (94) from the hard armor (12).

Figure 8:
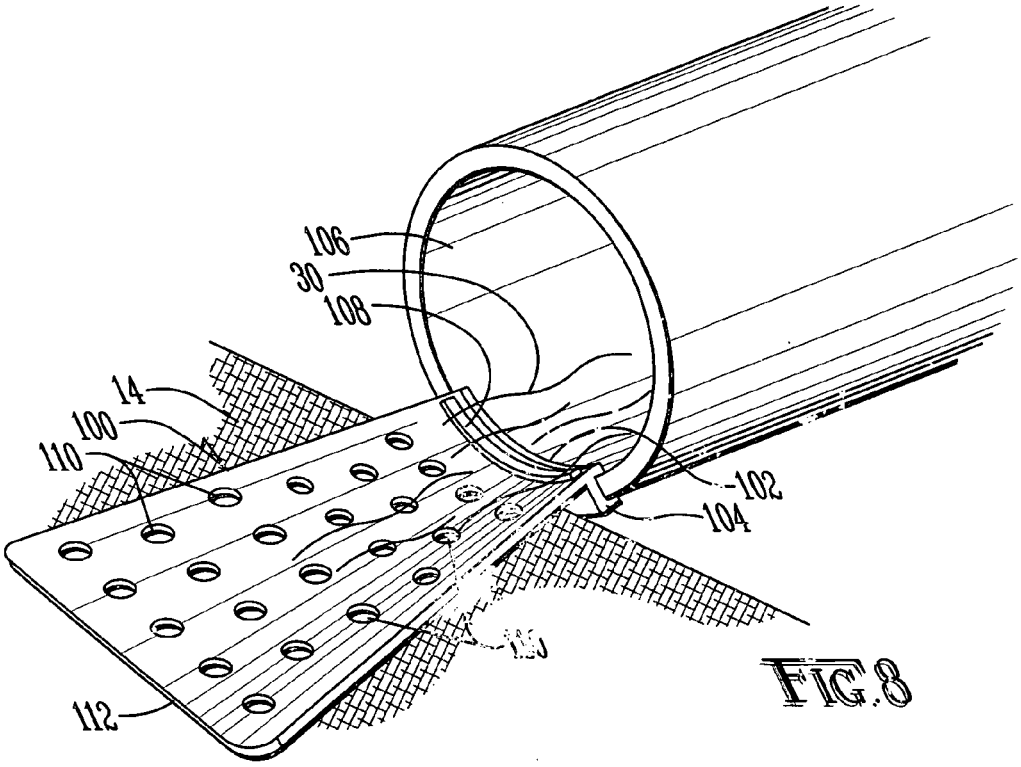
FIG. 8 illustrates a top perspective view of an alternative embodiment of the present invention showing an erosion control transition mat having a curved surface coupled to an outlet pipe which expands and flattens outward over a soft armor surface.

Still another alternative embodiment of the present invention is shown generally as (100) in FIG. 8. As shown in FIG. 8, the mat (100) is curved near its leading edge (102) and coupled via a slip end lock system (104) such as that described and secured to a drainage pipe (106) such as those known in the art. As shown in FIG. 8, the mat (100) flattens outward as it extends over the soft armor (14). The mat is provided with a riser (108) and a plurality of voids (110) in a manner such as that described above. By following the contour of the drainage pipe (106) at the leading edge (102) and flattening toward its trailing edge (112), the mat (100) protects the soft armor (14) from scour associated with the erosive effects of the effluent (30) at the point where the soft armor (14) meets the drainage pipe (106).

Figure 9:
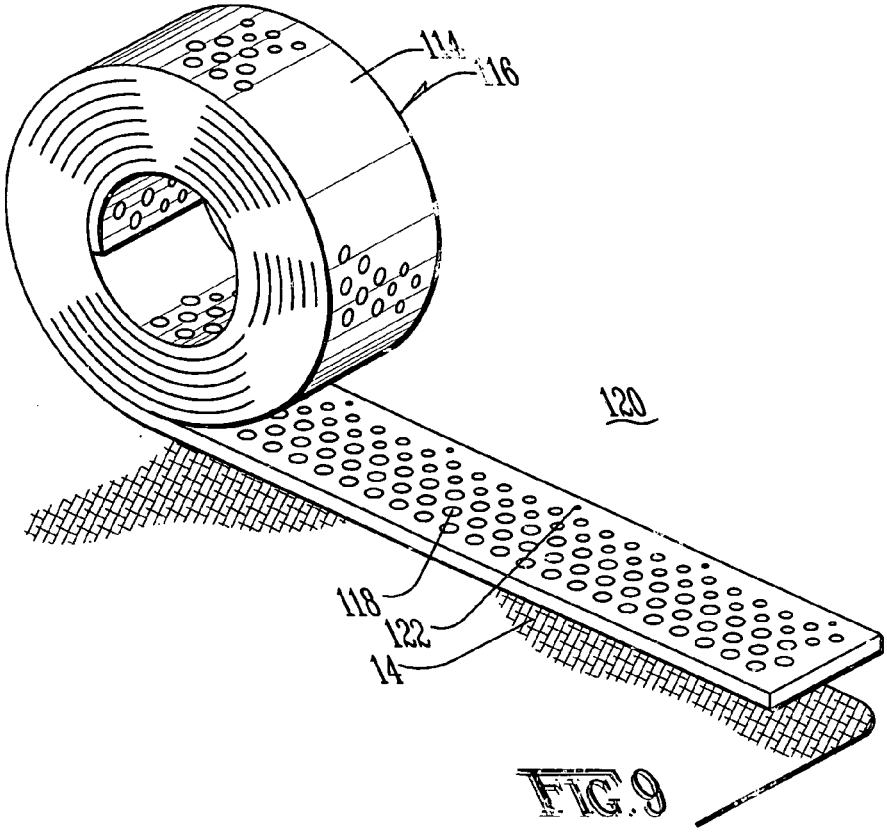
FIG. 9 illustrates a top perspective view of an alternative embodiment of the present invention showing an erosion control transition mat being laid from a roll between soft armor and soil.

Yet another alternative embodiment of the present invention is shown generally as (116) in FIG. 9. The erosion control transition mat (116) is provided in a roll (114) and is laid over the transition between soft armor (14) and the soil (120). As shown, the mat (116) is provided with a plurality of holes (118) and is secured into place by a plurality of pins (122) passing through the mat (116) into the soil (120).

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. The mat (10) may, of course, be utilized in any desired design configuration or combination of features, including voids of various sizes and shapes and/or vertical impediments, designed for specific disruption, dissipation and/or diminution of effluent force.

What is claimed is:

1. An erosion control transition mat system comprising:

(a) a first erosion control surface;

(b) a second erosion control surface;

(c) a third erosion control surface in overlapping relationship relative to said first erosion control surface and said second erosion control surface, said third erosion control surface comprising:

(i) first means for slowing fluid exiting said first erosion control surface, and for directing at least a portion of said fluid through said third erosion control surface, onto said second erosion control surface;

(ii) second means for slowing fluid exiting said first erosion control surface, and for directing at least a portion of said fluid through said third erosion control surface, onto said second erosion control surface.

2. The erosion control transition mat system of claim 1, wherein said third erosion control surface is secured to said first erosion control surface.

3. The erosion control transition mat system of claim 1, wherein said first slowing and directing means is a surface defining a slot.

4. The erosion control transition mat system of claim 3, wherein said second slowing and directing means is a supplemental surface defining a supplemental slot.

5. The erosion control transition mat system of claim 1, further comprising a riser provided on said third erosion control surface.

6. The erosion control transition mat system of claim 1, further comprising a plurality of risers provided on said third erosion control surface.

7. The erosion control transition mat system of claim 1, wherein said third erosion control surface comprises:

(a) a rigid surface having a first end and a second end, said rigid surface defining a plurality of holes;

(b) a riser positioned between said first end and said plurality of holes.

8. The erosion control transition mat system of claim 7, wherein said third erosion control surface tapers outward from said first end to said second end.

9. The erosion control transition mat system of claim 7, wherein said riser rises at least two centimeters from a surface of said third erosion control surface.

10. The erosion control transition mat system of claim 1, wherein said first erosion control surface is hard armor and wherein said second erosion control surface is soft armor.

11. The erosion control transition mat system of claim 1, wherein said first erosion control surface is hard armor and wherein said second erosion control surface is soil.

12. An erosion control transition system comprising:

(a) an erosion resistant area;

(b) an erosion susceptible area;

(c) a rigid transition mat provided in overlapping relationship relative to said erosion resistant area and said erosion susceptible area, said transition mat comprising means for directing a fluid from said erosion resistant area, through said transition mat, and onto said erosion susceptible area.

13. The erosion control transition system of claim 12, wherein said directing means is a surface provided with a hole through said transition mat.

14. The erosion control transition system of claim 12, wherein said directing means is a surface defining a plurality of holes.

15. The erosion control transition system of claim 14, wherein said transition mat further comprises means for diverting said fluid upward.

16. The erosion control transition system of claim 12, wherein said transition mat further comprises means for diverting said fluid upward.

17. A method for reducing erosion at a transition site, comprising:

(a) providing an erosion resistant area;

(b) providing an erosion susceptible area;

(c) positioning a rigid transition mat in overlapping relationship with said erosion resistant area and said erosion susceptible area;

(d) providing said transition mat with a hole;

(e) securing said transition mat to said erosion resistant area; and (f) directing fluid from said erosion resistant area, over said transition mat, through said hole in said transition mat, and onto said erosion susceptible area.

18. The method for reducing erosion at a transition site of claim 17, further comprising diverting said fluid upward prior to diverting said fluid through said hole in said transition mat.

19. The method for reducing erosion at a transition site of claim 17, further comprising growing vegetation upward from said erosion susceptible area through said hole in said transition mat.

20. The method for reducing erosion at a transition site of claim 17, wherein said erosion resistant area is hard armor and said erosion susceptible area is soft armor.

* * * * *